United States Patent [19]

Marinakis

[11] 4,387,888

[45] Jun. 14, 1983

[54] TABLE APPARATUS

[76] Inventor: James Marinakis, 1703 Wilshire Blvd., Santa Monica, Calif. 90403

[21] Appl. No.: 229,325

[22] Filed: Jan. 29, 1981

[51] Int. Cl.[3] ..... A61G 13/00

[52] U.S. Cl. ..... 269/324

[58] Field of Search ..... 269/322–328; 5/66–69; 128/69–71

[56] References Cited

U.S. PATENT DOCUMENTS

| | | | |
|---|---|---|---|
| 137,596 | 4/1873 | Clinton et al. | 269/326 |
| 1,626,091 | 4/1927 | Macklin | 269/326 |

FOREIGN PATENT DOCUMENTS

| | | | |
|---|---|---|---|
| 91747 | 3/1958 | Norway | 269/325 |

*Primary Examiner*—Robert C. Watson

*Attorney, Agent, or Firm*—H. Gordon Shields

[57] ABSTRACT

A table designed for the positioning of the human body includes sections movable independently of each other and jointly in cooperation with adjacent sections to enable a human body to be placed in various positions. The table includes a base frame with a central rod. First and second thoracic leaves are pivotally secured to the central rod. A rear frame is pivotally connected to the base frame and an inomate plate is pivotal on the rear frame. Each of these pivotal frames and leaves includes lock and release mechanisms.

15 Claims, 8 Drawing Figures

40
42
44
46
50
52
54
56
58
202
204
206
208
210
212
214
216
218
290
292
294
296
298
300
302
304
306
308
310
312
314
360
390
392
394
396
400
408
410
412
414
260
B

TABLE APPARATUS

BACKGROUND OF THE INVENTION

1. Field of the Invention

This invention relates to tables, and more particularly to tables adapted for the positioning of the human body.

2. Description of the Prior Art

Various types of tables have been designed and developed over the years for the positioning of the human body for various types of examinations and manipulations. Such tables tilt about one or more axes and they include various portions or sections which move independently or in concert. They generally allow the human body, or various parts of the human body, to be appropriately positioned, as desired, for the type of manipulation or examination to be made by a user of the table.

The tables may be operated or positioned by hydraulic pressure, by spring pressure, by manual cranking of cranks and gears, or by physically positioning the table at a predetermined location by virtue of racks, slots, and the like, cooperating with physical stops to effect the positioning and maintaining of the table, or a part of the table, in a particular orientation.

It is sometimes desirable to move one or more parts independently of each other, and perhaps move parts relative to each other in equal increments. It is also sometimes desirable to move a portion of a table independently of other portions of the table, and sometimes necessary to move a particular portion, which may be movable independently, in concert with another portion of the table, and then to return the table to its original orientation. The apparatus of the prior art have limitations in their ability to be moved rapidly, with precision, and to be returned to an original position with dispatch and without discomfort to the person disposed on the table.

SUMMARY OF THE INVENTION

The invention described and claimed herein comprises a table having movable portions designed for the examination and/or manipulation of the human body, and which table positions a human body, as desired by the user of the table, and allows the user of the table to position the various portions of the table as desired with minimum effort and further allows the table to be returned to its original position again with ease and with comfort to the person disposed on the table. Various types of mechanical elements are used to effect the cooperative and/or independent movement of the various portions of the table.

Among the objects of the present invention are the following:

To provide new and useful table apparatus;

To provide new and useful table apparatus for positioning a body for manipulation of the body;

To provide new and useful table apparatus having a plurality of sections movable independently of each other and in concert with each other;

To provide new and useful table apparatus movable to a plurality of positions; and To provide new and useful table apparatus having a plurality of sections movable to position a body for manipulation of the body.

DESCRIPTION OF THE PREFERRED EMBODIMENT

Figure 1:
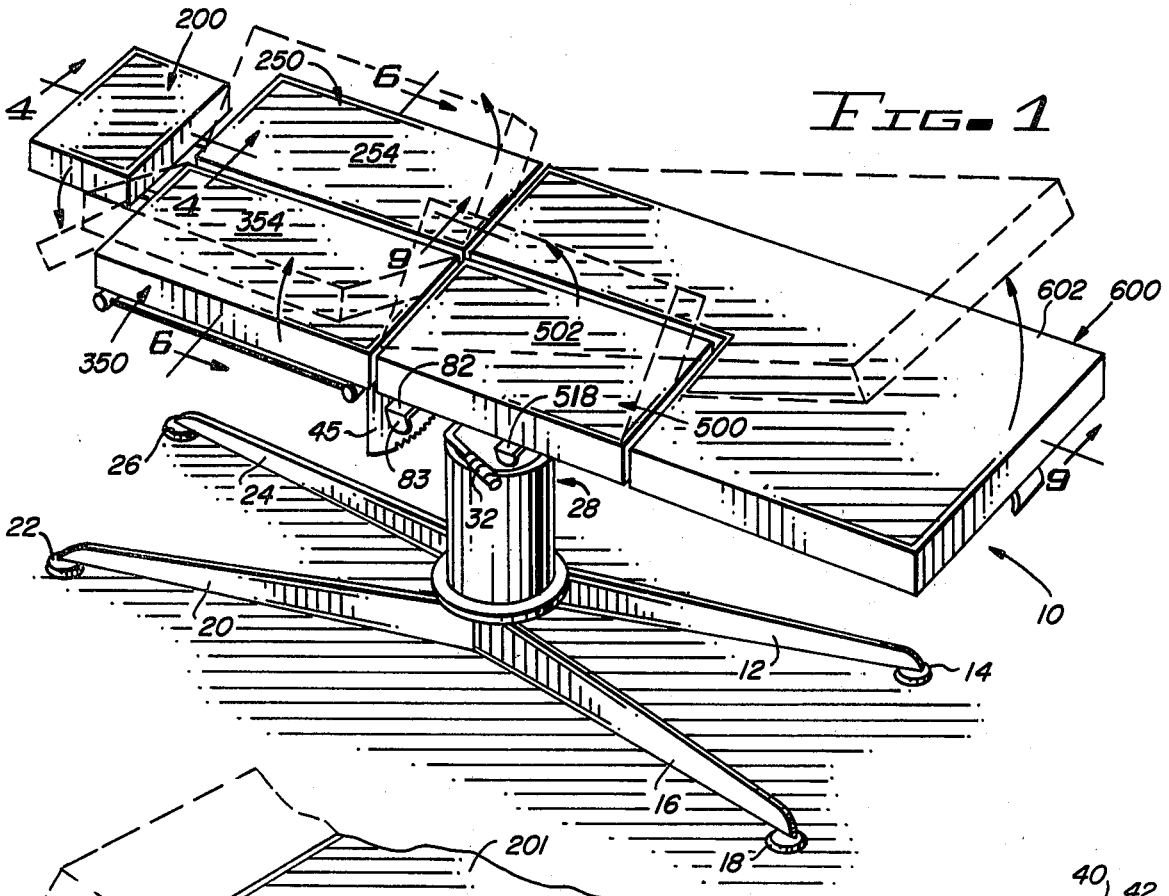
FIG. 1 is a perspective view of the apparatus of the present invention.
Figure 3:
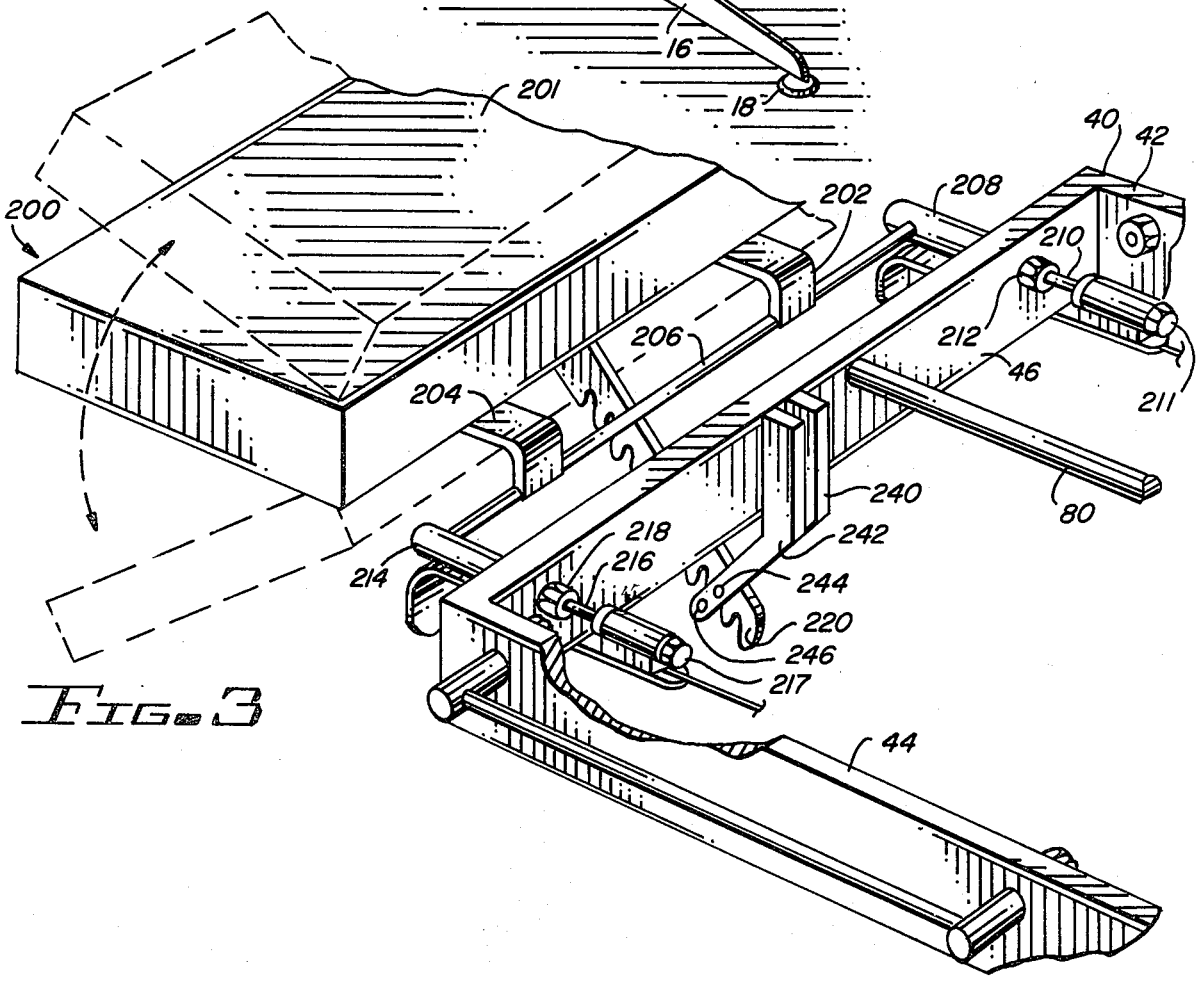
FIG. 3 is a perspective view to an enlarged scale of a portion of the apparatus of FIG. 1, with elements of the apparatus broken away for clarity and detail.
Figure 2:
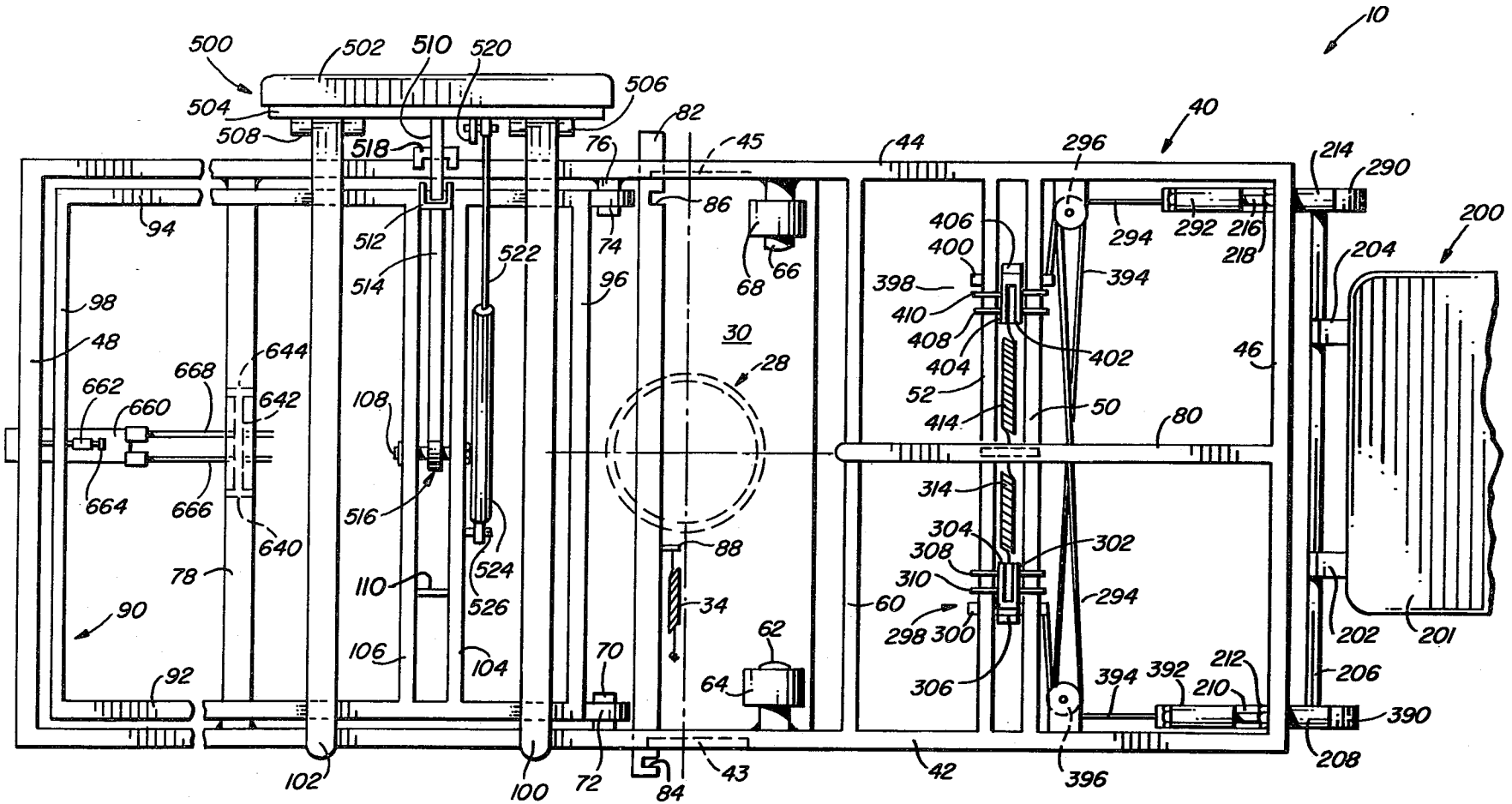
FIG. 2 is a top view of a portion of the apparatus of the present invention.
Figure 4:
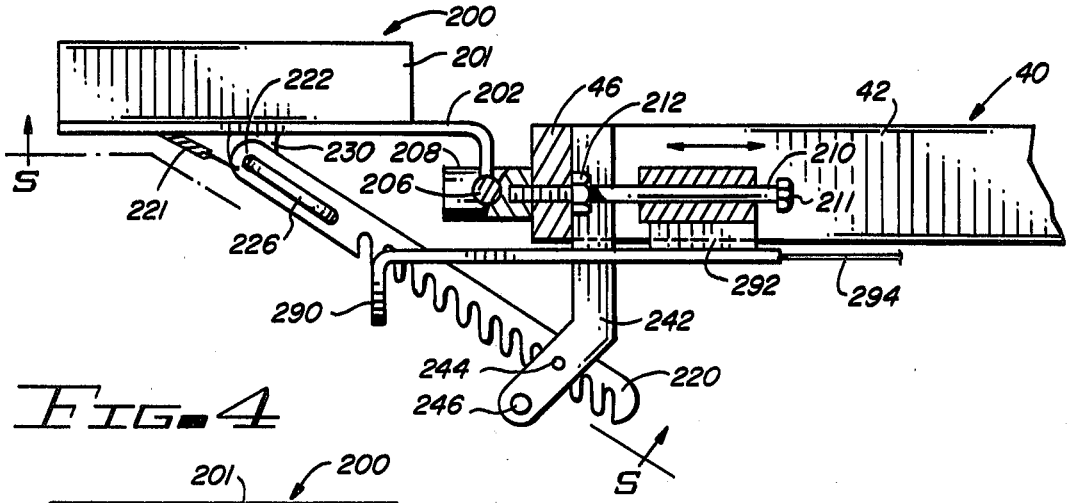
FIG. 4 is a view in partial section of a portion of the apparatus of FIG. 1, taken generally along line 4—4 of FIG. 1.
Figure 5:
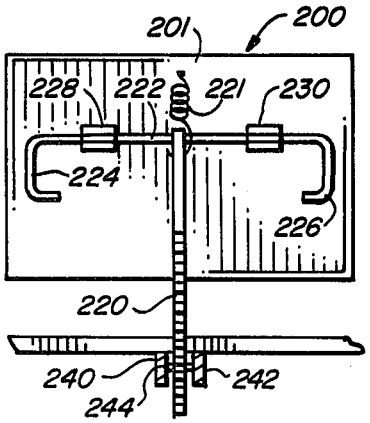
FIG. 5 is a bottom view of a portion of the apparatus of FIG. 4, taken generally along line 5—5 of FIG. 4.
Figure 6:
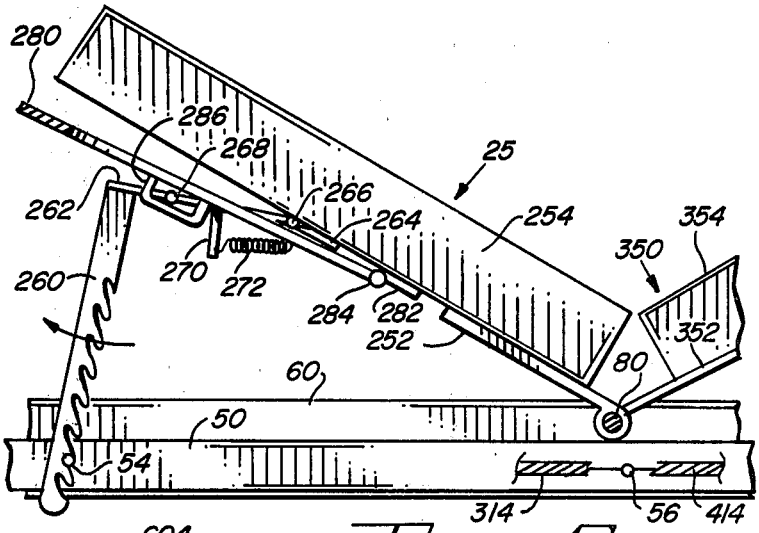
FIG. 6 is a view in partial section of a portion of the apparatus of FIG. 1, taken generally along line 6—6 of FIG. 1.
Figures 7, 8:
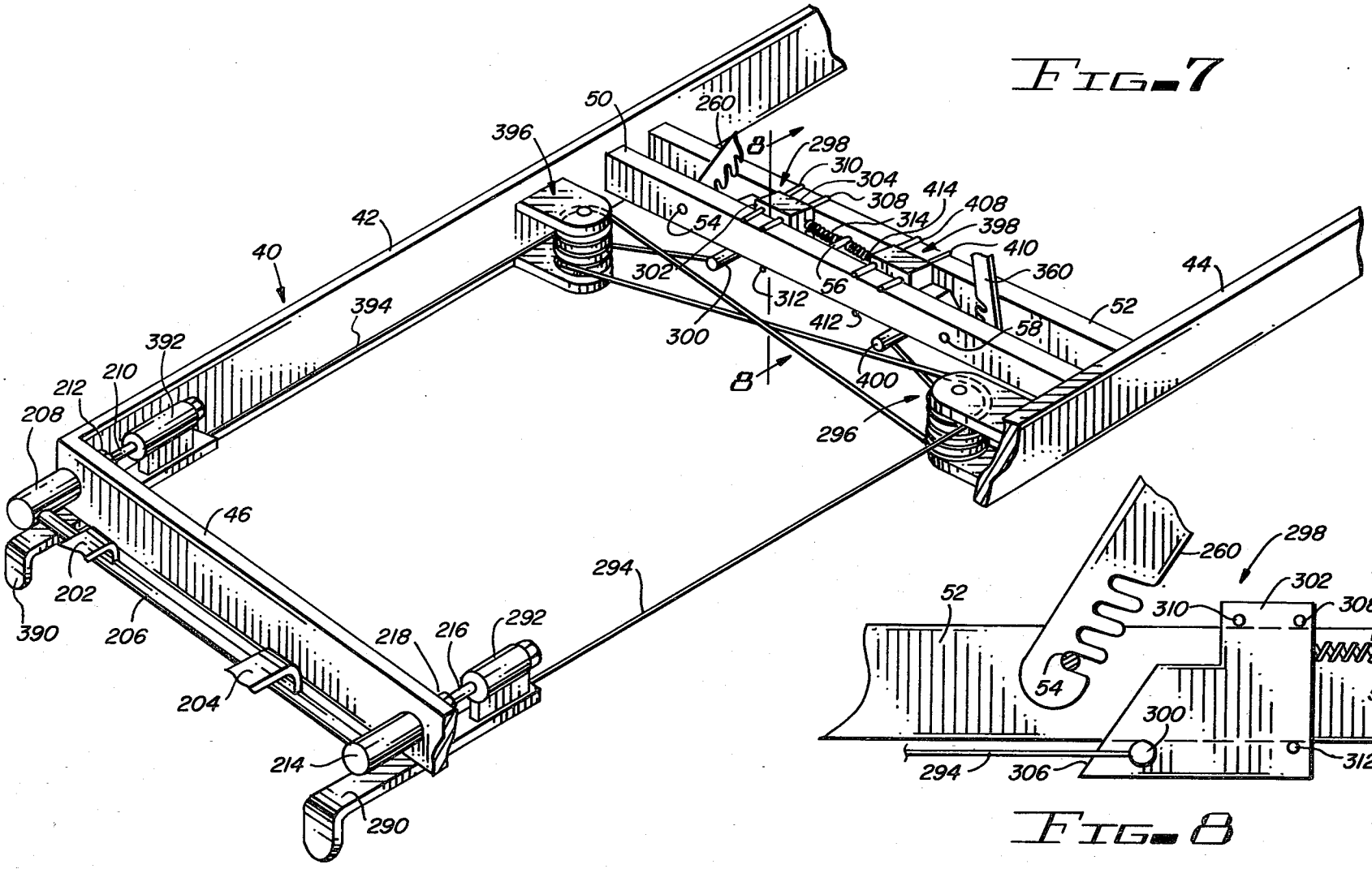
FIG. 7 is a perspective view of a portion of the apparatus of the present invention illustrating a mechanical release system for the apparatus shown in FIG. 6.
FIG. 8 is an enlarged view of a portion of the apparatus of FIG. 7 taken generally along line 8—8 of FIG. 7.

FIG. 1 comprises a perspective view of myopractic table apparatus 10 which comprises the present invention. FIG. 2 is a top view of the frame apparatus of the table 10, illustrating the structural elements of the table apparatus. FIG. 3 is a perspective view on an enlarged scale of a portion of the table apparatus 10 of FIG. 1, with elements of the apparatus removed and/or broken away to illustrate the movement and the mechanical interrelation of a portion of the elements of the table. FIG. 4 is a view in partial section of a portion of the apparatus of FIG. 1, taken generally along line 4—4 of FIG. 1, illustrating further some of the mechanical operation and interrelation of elements of table apparatus 10. FIG. 5 is a bottom view of a portion of the apparatus of FIG. 4, taken generally along line 5—5 of FIG. 4, illustrating the mechanical positioning, holding, and releasing of a portion of the table apparatus 10. FIG. 6 is a view in partial section of a portion of the table apparatus 10 of FIG. 1, taken generally along line 6—6 of FIG. 1, and illustrating, among other things, a manual positioning and releasing system for part of the table apparatus 10. FIG. 7 is a perspective view of a portion of the frame of the table apparatus 10, illustrating a mechanical release system for the elements illustrated primarily in FIG. 6, and also illustrated in FIG. 1. FIG. 8 is an enlarged view of a portion of the apparatus of FIG. 7, taken generally along line 8—8 of FIG. 7. The following discussion concerning the table apparatus 10 will be primarily directed to FIGS. 1-8. Further details of the table apparatus 10 shown in FIGS. 9 and 10 will be discussed below.

The myopractic table apparatus 10 includes four legs 12, 16, 20, and 24. Each leg extends outwardly from a hydraulic cylinder unit 28 and terminates in a support pad. Support pads 14, 18, 22, and 26 are secured to the distal ends of the legs 12, 16, 20, and 24, respectively. The hydraulic cylinder unit 28 is of a conventional, well known design. It is used to vertically raise and lower the upper portions of the table apparatus 10.

As best shown in FIG. 2, the table apparatus 10 includes a frame 40, which is of a generally rectangular configuration. The frame includes a pair of spaced apart and generally parallel side members or elements 42 and 44, secured to a spaced apart and generally parallel pair of end frame members or elements 46 and 48. A plate 30 extends between, and is appropriately secured to, the side frame members 42 and 44. The hydraulic unit 28 is in turn secured to the plate 30.

Several cross members extend between, and are appropriately secured to, the side frame members 42 and 44, in addition to the plate 30. They include a pair of cross members 50 and 52, which are spaced apart a relatively short distance, and which are generally parallel to each other. The cross members 50 and 52 are located between the plate 30 and the end frame member 46. Another cross member 60 also extends between the side frame members 42 and 44, adjacent the plate 50, and spaced apart from the cross members 50 and 52. The cross members 50 and 52 are spaced apart from the end cross member 46 and between the end frame member 46 and the cross member 60. The cross member 60 is adjacent the plate 30.

The plate 30 is secured to the frame 40 by a pair of pins 62 and 66, which are secured to the side frame members 42 and 44, respectively, and which extend generally inwardly, aligned with each other, from their respective frame members. The pins 62 and 66 comprise hinge pins for a pair of hinges 64 and 68 which are in turn secured to the plate 30. The frame 40 pivots on the plate 30, and accordingly on the hydraulic unit 28 and the supporting legs 12, 16, 20, and 24, through the pin/-hinge combinations 62, 64, and 66, 68. The frame 40 is secured in place relative to the plate 30 by the cooperation of a pair of ratchet plates 43 and 45, which are secured to the side frame members 42 and 44, respectively, as best shown in FIGS. 1 and 2. The ratchet plates 43 and 45 each include a number of ratchet teeth which are locked in place by means of a lock bar 82. The lock bar 82 includes a handle 83, best shown in FIG. 1. Movement of the lock bar 82 releases the teeth on the plates 43 and 45, to allow the frame 40 to move in a limited arc relative to the plate 30 and to the base of the table 10, which includes the legs 12, 16, 20, 24, and the hydraulic cylinder 28.

The lock bar 82 extends laterally across the frame on the plate 30 and beneath the frame 40, as best shown in FIG. 1. The locking or lock bar 82 includes a pair of notches 84 and 86, best shown in FIG. 2, which, when aligned with the teeth on the ratchet plates 43 and 45, allow the teeth to move through the notches 84 and 86. The arcuately extending ratchet plates, with their ratchet teeth, may move through the notches 84 and 86 to allow the frame 40 to be tilted relative to the plate 30 and to the base of the table apparatus 10 on the cooperating pins 62 and 66 and their respective hinges 64 and 68. As indicated above, the pins 62 and 66 are secured to the side frame members 42 and 44, respectively, and the hinges 64 and 68 are secured to the plate 30 and they receive the pins 62 and 66.

A pin 88 extends outwardly from the bar 82 within the frame 40. A tension spring 34 is secured to the plate 30 and to the pin 88 to bias the locking bar 82 into engagement with the ratchet teeth 43 and 45. This bias causes the notches 84 and 86 to be moved away from the ratchet teeth, thus allowing the bar 82 to extend through and accordingly lock the ratchet teeth 43 and 45 in place. The locking of the ratchet teeth prevents movement of the frame 40 relative to the plate 30.

The locking bar 82 is appropriately secured to the plate 30 and guided in a relatively direct area of movement, namely laterally with respect to the frame apparatus 10. Accordingly, when the bar 82 is aligned with and disposed within the teeth of the ratchet plates 43 and 45, the plate 30 and the frame 40 are locked together to prevent relative movement. When the locking bar 82 is moved (pushed or pulled) against the bias of the spring 34, the notches 84 and 86 align with the ratchet teeth on the ratchet plates 43 and 45 to allow movement of the ratchet teeth and their plates through the notches to allow relative movement between the bar 82 and the frame 40.

It will be noted from FIG. 2 that the locking bar 82 extends outwardly (laterally) from the table apparatus 10. It may thus be adjusted or moved from either side of the table to allow the table to be moved or pivoted, as desired. The bar 82 includes two handles, one handle on each end of the bar and accordingly on each side of the table 10. Only the handle 83 is shown in the drawing. Handle 83 is shown in FIG. 1.

Since there are a plurality of ratchet teeth on each of the plates 43 and 45, the table frame 40 may be disposed at any of a plurality of angular adjustments with respect to the base of the table, comprising the plate 30 and the hydraulic unit 28 and the legs secured thereto. The adjustment or positioning of the frame 40 is accomplished by moving the bar 82 and moving the table frame to the desired angular orientation, with the notches 84 and 86 of the bar 82 aligned with the ratchet plates. When the desired angular orientation of the table frame 40 is reached, the locking bar 82 is then allowed to move with the bias of the spring 34, causing the notches 84 and 86 to move out of alignment with the ratchet plates. When the alignment of the notches is removed from the ratchet plates, a part of the width of the locking bar 82 extends through the teeth, or through the notches between the teeth, of the ratchet plates 43 and 45 to lock the frame 40 relative to the plate 30 and base of the table.

Referring again to FIG. 1, the table frame 40 moves on its pivot points, or its pivot pins 62 and 66, which extend through hinges 64 and 68 and which are in turn secured to the plate 30. The frame 40 thus pivots relative to the plate 30 and to the hydraulic unit 28. The hydraulic unit, as indicated above, is a well-known and understood assembly. The actuation of the hydraulic unit allows the plate 30, and the table secured thereto, to be moved vertically upwardly and downwardly, relative to the base legs, 12 . . . 24. The hydraulic unit is actuated by a handle 32. Pumping the handle by moving the handle in an arcuate manner, with an appropriate valve (not shown) properly positoned, allows the plate 30 and the frame 40 secured thereto, to be moved by a piston which is part of the hydraulic unit 28. Another appropriate positioning of the valve allows the table to be moved downwardly, as desired. Such functioning or movement is well known and understood.

Secured to the table frame 40 is a rod 80 which extends between the front or upper end frame member 46 and the cross frame member 60. The rod 80 is centrally located between the side frame members 42 and 44. Its function will be discussed more in detail, particularly in conjunction with FIG. 6.

A rear frame 90 is also secured to the main, table frame 40. The rear frame 90 includes a pair of spaced apart and generally parallel side frame members or elements 92 and 94. The side frame members 92 and 94 are in turn secured to a pair of spaced apart and also parallel end frame members or elements 96 and 98. The rear frame 90 is movably disposed within the frame 40, as best shown in FIG. 2.

A pair of transversely extending cross members 100 and 102 are disposed on the top of the frame 90 and they are appropriately secured to the frame members 92 and 94. The cross members 100 and 102 extend laterally beyond the frame members 92 and 94, and they overlie the side frame members 42 and 44 of the main frame 40. They thus act as stops to limit the downward movement of the frame 90 relative to the frame 40.

Another cross frame member 78 extends laterally between the side frame members 42 and 44. The cross frame member 78 is appropriately secured, as by welding, to the lower portions of the side frame members 42 and 44. The cross member 78 is spaced apart from the end frame member 48, and is generally parallel thereto. The member 78 is disposed beneath the pivoting rear frame 90.

Between the cross members 100 and 102 are a pair of spaced apart cross members 104 and 106 which extend between the side frame members 92 and 94. The cross members 104 and 106 are spaced apart a relatively short distance. A pin 108 is appropriately secured to the cross members 104 and 106 about midway between the side frame members 92 and 94. The frame members 104 and 106 and their pin 108 will be discussed in detail below.

The table apparatus 10 is designed, of course, for a person to repose thereon or, as will be discussed below, there against. For practical purposes, the table apparatus 10 will be discussed from the head (front) or upper portion of the table downwardly. At the upper or head end of the table 10 is a head piece 200. The head piece 200 includes a cushion 201, which is of a generally rectangular configuration. The head piece 200 is secured to the primary or main table frame 40 by a pair of brackets 202 and 204, shown in FIGS. 2, 3, and 4. The brackets 202 and 204 are generally of an "L" shaped configuration, with the long arms of the L's secured to the bottom or underneath side of the cushion 201, and the short arm or leg of each bracket appropriately secured to a rod 206. The rod 206 is spaced apart from the front or head end piece 46 of the frame 40 by a pair of posts 208 and 214. The posts 208 and 214 are in turn secured to the frame member 46 by a pair of bolts or screws 210 and 216, respectively. This is best illustrated in FIGS. 3 and 4.

In FIG. 4, the post 208 is shown in partial section, as is the frame member 46. The bolt 210 is shown as an elongated bolt which includes a head 211 spaced apart from the frame member 46. The post 208 is internally threaded, and the externally threaded shank portion of the bolt 210 extends into the threaded bore of the post 208. A portion of the threaded shank of the bolt 210 extends through the member 46 and inwardly with respect to the frame 40. A nut 212 is shown disposed against the frame member 46. With the nut 212 drawn tightly against the frame member 46, the post 208 is held securely against the frame 40. The post 214 is similarly secured to the frame member 46 by a nut 218 disposed on the bolt 216, as shown in FIG. 3. The length of the shank of the bolts 210 and 216 between the nuts 212 and 218 and their respective heads 211 and 217 will be discussed below.

In FIG. 3, the cushion portion 201 of the head piece 200 is shown in a generally horizontal position, with an angular orientation of the cushion 201 illustrated in phantom, along with an arcuate double headed arrow. The head piece 200 accordingly is movable through an arc to allow a person disposed on the table apparatus 10 to have their head positioned, as desired. The head piece 200 is accordingly arcuately pivotable on the rod 206.

To lock the cushion 201 in a particular position, as desired by the user of the table apparatus 40, a ratchet locking bar 220 is used. The bar 220 includes a plurality of ratchet teeth, as best shown in FIGS. 3 and 4. The bar 220 is secured to a pin 222 which is in turn secured to the bottom of the cushion 201 by a pair of brackets 228 and 230, as best shown in FIG. 5. The pin 222 is integral with the bar 220, and accordingly pivots in the brackets 228 and 230.

A pair of handles 224 and 226 are secured to opposite ends of the pin 222. The handles allow the bar 220 to be easily moved as desired. Employing one hand to hold or brace the cushion 201, a user's other hand moves the bar 220 by means of either of the handles 224 or 226 to allow the cushion 201 to be located, or positioned, as desired, by the user, relative to the table frame 40.

The bar 220 locks in place by the engagement of any one of its ratchet teeth with a pin 244 which is secured to and extends between a pair of brackets 240 and 242. As best shown in FIG. 3, the brackets 240 and 242 are secured to the end frame member 46 and extend downwardly and angularly outwardly therefrom. The pin 244 extends between the brackets 240 and 244 and cooperates with any one of the ratchet teeth to lock the head piece 200 securely to the frame 40. A distal pin 246 extends between the brackets 240 and 244 remotely from the frame member 46. It comprises a spacer and lock element for securing the two brackets together. The bar 220, with its ratchet teeth, extends between the brackets 240 and 242.

A tension spring 221 is secured between the bottom of the head piece 200 and the bar 220. The spring biases the bar 220 downwardly (clockwise in FIG. 4) to urge the ratchet teeth of the bar 220 into engagement with the pin 244.

Adjacent the head piece 200, and overlying the upper portion of the frame 40 adjacent the upper end member 46, and over the rod 80, and extending from the frame member 46 to the cross member 60, are a pair of thoracic leaves 250 and 350. The thoracic leaves 250 and 350 are secured to and pivot on the rod 80, as best shown in FIG. 6. The rod 80 comprises the pivot pin about which the leaves move, with the outer ends of the leaves moving upwardly, as best shown in FIG. 6. The leaves 250 and 350 are independently movable on the rod 80.

The leaves 250 and 350 are secured to the rod 80 by appropriate brackets, such as hinge brackets 252 and 352, secured respectively to a cushion 254 and a cushion 354 of the leaves 250 and 350, respectively. The cushions 254 and 354 are generally of a rectangular configuration, as best shown in FIG. 1. The leaves 250 and 350 pivot on the rod 80, by the hinge-like action of the brackets 252 and 352 with respect to the rod 80. The width of the leaf cushions 254 and 354 is such that they extend outwardly from the center of the table apparatus 10, with which the rod 80 is aligned, and overlie the outer frame members, including a portion of the side frame members 42 and 44 and the end member 46.

In the "down" position as shown in FIG. 1, the thoracic leaves 250 and 350 are disposed on the frame 40. In the "up" position, as shown in FIG. 6 and as illustrated in phantom in FIG. 1, the cushions 254 and 354 are supported on the frame 40 by appropriate ratchet bars, similar to the ratchet bar 220 which supports the head piece 200. The support structure for the leaf 254 is shown in FIG. 6.

A ratchet bar 260 is shown in FIG. 6 as locked in place on a pin 54 which extends between the pair of cross members 50 and 52. See also FIGS. 7 and 8. The cross members 50 and 52 are best shown in FIG. 7 with respect to the support structure for the thoracic leaves 250 and 350. In FIG. 7 is shown a portion each of the ratchet toothed support bar 260 for the thoracic leaf 250 and of a ratchet toothed support bar 360 for the thoracic leaf 360. The support bars 260 and 360 are shown in FIG. 7 as locked in place on a pair of pins 54 and 58. The pins 54 and 58 extend between, and are secured to, the cross members 50 and 52.

The ratchet toothed support bar 260 is secured to a plate 262, best shown in FIG. 6. The plate 262 is pivotally secured to a base 264 by a hinge pin 266. The base 264 is secured to the bottom or underneath portion of cushion 254. The plate 262 and its bar 260, which is integral therewith, pivots on the pin, or about the pin, 266, relative to the base 264 and to the cushion 254.

Extending outwardly from the plate 262, and between the bar 260 and the base 264, is a pin 268. The pin 268 extends laterally outwardly from the plate 264 and into a bracket 286 secured to an unlocking or unlatching lever 280.

Between the pin 268 and the base 264 is another pin 270. The pin 270 is secured to the plate 262 and extends downwardly or in a counterclockwise direction, with respect to the cushion 254 as shown in FIG. 6.

The unlocking lever 280 is secured to a base 282 by means of a pivot pin 284. The base 282 is secured to the bottom or underneath side of the cushion 254 by appropriate fastening means, just as the base 264 is and as the bracket 252 is. Upward pressure on the outer portion of the lever 280, remote from the hinge pin 284, causes a corresponding upward movement of the bracket 286 which extends downwardly from the under side of the lever 280.

The bracket 286 is of a generally "U" shaped configuration, with a bottom leg of the "U" elongated, and with the pin 268 of the plate 262 extending through the bracket. Movement of the lever 280 and the bracket 286 results in movement of the bar 260 and the plate 262 to which it is attached through the pin 268 and the bracket 286. The width (or length) of the bracket 286 compensates for the difference in length of the lever 280, from its pivot point at the pin 284, outwardly with respect to the pivoting of the plate 262 from its pivot point 266 to the pin 268.

As best illustrated in FIG. 6, an upward movement of the lever 280 causes the pin 268, secured to the plate 262, to be moved upwardly with respect to the pivot pins 284 and 266 of the lever 280 and the plate 262, respectively. The movements result in corresponding pivoting movements of both the lever 280 and the ratchet tooth support bar 260 secured to the plate 262. The movement of the bar 260 is in a clockwise direction, and arcuate with respect to the pivot point of the plate 262 to which it is secured.

The movement of the bar 260, as indicated by the arrow in FIG. 6, causes a disengagement of the ratchet teeth of the bar 260 from the pin 54, thus allowing the thoracic leaf 250 to be positioned, as desired, either upwardly or downwardly. The upward positioning of the thoracic leaf 250 is, of course, limited by the length of the bar 260 and by the number of the ratchet teeth thereon. Similarly, the downward movement, to an intermediate position other than full down, is also limited by the number of teeth on the bar 260 which may engage with the pin 54. In the full down position, the leaf 250 is disposed on the frame 40. The bottom of the cushion 254 is supported in part by the side frame member 42 and the end frame member 46, and in part by the bar 80 by means of the bracket or hinge 252.

The thoracic leaves 250 and 350 move independently of each other. While both pivot on the rod 80, which is disposed on the center line of the frame 40, they are separately or independently moved to their desired heights. Rod 80 accordingly comprises a hinge pin for both of the thoracic leaves 250 and 350. The bar 260 and the pin 250, which meshes with the ratchet teeth of the bar 260, and the other elements associated therewith, as discussed above, with respect to the thoracic leaf 250, are duplicated with respect to the thoracic leaf 350. The above discussion accordingly is pertinent also to the thoracic leaf 350.

While the thoracic leaves are independently adjusted vertically upwardly, they may be lowered substantially simultaneously by a second unlocking system. The plate or lever system including the lever 280, are adjustable from the side of the table apparatus 10, the secondary unlocking or releasing system is actuable from the front or head portion of the table apparatus 10. The secondary system is best illustrated in FIGS. 2, 3, 4, 7, and 8.

The secondary release system includes a pair of handles 290 and 390 which are disposed beneath the front frame member 46 and secured to a pair of guides 292 and 392, respectively, to the bolts 216 and 210, respectively. The bolts 210 and 216, as discussed above, secure the posts 208 and 214, respectively to the frame member 46. Nuts 212 and 218 are used to secure the bolts 210 and 216, respectively, to the frame member 46. The bolts are longer than needed solely for the purpose of securing the posts 208 and 214 to the frame member 46, and the extra length of the bolts, within the frame 40, is used as a rod or rail on which the guides 292, 392 move for the secondary release system of the thoracic leaves. The handles 290 and 390 are substantially identical to each other. They each comprise an elongated strap, with the elongated length extending substantially horizontally, beneath the parallel to the frame 40, and with a downwardly extending tab portion. The downwardly extending tab portions are convenient for grasping or pulling when using the secondary release system.

The guides 292 and 392 are substantially identical to each other. Each comprises a tubular member, which is disposed about the shank of their respective bolts, and a connecting element which extends between the tubular member and the handle member. The length of the bolt shanks between their nuts 212 and 218 and their distal ends or heads 211 and 217, respectively, is sufficient to allow room or distance for moving or actuating the handles for releasing the bars 260 and 360. The release of the bars 260 and 360 is accomplished by means of cables 294 and 394, respectively. The cables are secured to the handles by appropriate fastening means. A pair of pulley assemblies 296 and 396 are secured respectively to the frame members 44 and 42. Each of the pulley assemblies includes a pair of sheaves or individual pulleys, disposed in a vertical relationship to each other. Each pair of sheaves are secured to a common pin or axle, but rotate independently of each other.

The cable 294 extends to the pulley assembly 296 and is disposed on the top sheave. From the pulley assembly 296, the cable 294 extends transversely across the frame 40 to the pulley assembly 396. The cable 294 extends through or around the bottom or lower sheave of the pulley assembly 396. From the bottom sheave, the cable 396 extends to a pin 300 of a cam assembly 298. The cable is secured to the pin 300.

The cable 394 extends from the handle 390 to the pulley assembly 396. The cable extends around the top or upper sheave of the pulley assembly 396 and then transversely to the bottom or lower sheave of the pulley assembly 296. From the pulley assembly 296, the cable 394 extends to and is appropriately secured to a pin 400 of a cam assembly 398.

The cam assemblies 298 and 398 are disposed between the pair of transversely extending cross members 50 and 52. The cam assembly 298 comprises a block and four supporting pins. The block includes three main portions, a side 302, a side 304, and a cam surface 306. The sides 302 and 304 are disposed adjacent the frame members 50 and 52, respectively, as best shown in FIG. 2. The cam surface 306 extends between or transversely with respect to the sides 302 and 304.

The cam assembly 398 is substantially identical to the cam assembly 298. It comprises a block and four supporting pins. The block includes a pair of sides 402 and 404 and a cam or actuator surface 406 extending between the sides 402 and 404.

The operation of the cam assemblies 298 and 398 may best be understood by reference to FIGS. 7 and 8. The configuration of the sides 302 and 304 of the cam assembly 298 and the sides 402 and 404 of the cam assembly 398 are substantially identical. FIG. 8 comprises a side view of the cam assembly 298, with the side configuration of the assembly shown. The configuration of the cam assembly 398 is substantially identical. The orientation of the cam assembly 398 is reversed from that shown in FIG. 8 for the cam assembly 298, as may be understood from reference to FIGS. 2 and 7. The vertical height or length of the sides is greater than that of the frame members 50 and 52. The cam assemblies are supported by and moved on the frame members 50 and 52 on four transversely extending pins. The pins extend outwardly from the sides and on top of and under the frame members 50 and 52. Two pins are disposed on top of the frame members and two are disposed beneath the frame members.

For the cam assembly 298, two upper pins 308 and 310 are shown in FIGS. 7 and 8 as extending on top of the frame members 50 and 52. Extending beneath the frame members 50 and 52 are the pins 300 and 312. It will be noted that the diameter of the pin 300 is larger than that of the pins 308, 310, and 312. The reason for this is that the cable 296 is secured to the pin 300. Similarly, the pins 408 and 410 for the cam assembly 398 are disposed on top of the frame elements 50 and 52, and the pins 400 and 412 extend beneath the frame elements. The pin 400 is largest of the four pins, and the cable 394 is second to it.

The vertical spacing between the upper or top pair of pins and the lower or bottom pair of pins is slightly greater than the vertical height of the frame members 50 and 52 to allow the cam assemblies to move smoothly thereon. The spacing between the frame members 50 and 52 is slightly greater than the width of the blocks which comprise the cam elements to allow the cam assemblies to move therebetween smoothly.

The pin 56, which may be referred to as an anchor pin, extends between and is secured to the frame members or elements 50 and 52. A tension spring 314 extends from the pin 56 to which it is secured, to the cam assembly 298. The end of the spring 314 remote from anchor pin 56 is secured to the cam assembly block.

A tension spring 414 extends from the anchor pin 56 to the cam assembly block of the cam assembly 398. The purposes of the tension springs 314 and 414 are to provide a bias for urging the cam assemblies 298 and 398 inwardly, toward the center of the frame 40, and between the side frame members 42 and 44. The cables 294 and 394, and the handles 290 and 390, to which they are respectively secured, provide a limiting factor with respect to the inward distance that the cam assemblies 298 and 398 may move. This is a result of the length of the cables 294 and 394 and the distance which the handles 290 and 390 are allowed to move due to the heads 217 and 211 of the bolts 216 and 210, respectively, and to the guide elements 292 and 392, which are secured respectively to the handles 290 and 390, and which are disposed on the bolts 216 and 210, respectively.

In FIG. 8, the cam assembly 298 is shown disposed adjacent the bar 260. The cam surface 306 of the cam assembly 298 is shown spaced apart a slight distance from the lower or bottom portion of the locking bar 260. It will be noted that the cam surface 306 is sloping upwardly and rearwardly from its lower edge to its upper edge. The face accordingly defines a cam face which makes contact with the lower portion of the bar 260 as the cam assembly 298 is moved outwardly, or to the left, as viewed in FIG. 8. An outward force on the handle 290, outwardly or away from the frame element 46, as viewed in FIGS. 2, 3, 4, and 7, results in movement of the cable 294. The movement of the cable 294 is translated through the pulley assemblies 296 and 396 into a transverse or outward movement of the cam assembly 298 toward the side frame element 42, and away from the center of the frame 40 and away from the anchor pin 56, as best shown in FIGS. 2, 7, and 8. The movement of the cam assembly 298 causes the sloping face 306 to contact the lower portion of the support/locking bar 260. The continued movement of the cam assembly 298, resulting from continued movement of the handle 290, causes the support/locking bar 260 to move upwardly and outwardly which results in a disengagement of its ratchet teeth with the locking pin 54, as best shown in FIG. 8.

The disengagement of the ratchet teeth of the support/locking bar 260 and the locking pin 54 allows the thoracic leaf 250 to be moved, as desired. See FIG. 6. It will be noted that the cam assemblies are not shown in FIG. 6.

The operation of the cam assembly 298 with respect to the handle 390 and the support/locking bar 360 is substantially as described, above, for the cam assembly 298, its handle 290, and its support/locking bar 260.

The tension bias of the springs 314 and 414 urges the cam assemblies 298 and 398, respectively, away from their respective thoracic leaf support/locking bars and towards the center pin 56. This is turn results in a bias applied to the cables 294 and 394 to urge the handles 290 and 390, respectively, inwardly with respect to the table. The guides 292 and 392 accordingly are urged against the heads 217 and 211 of the bolts 216 and 210, respectively. A positive outward bias or pull is accordingly required on the respective handles 290 and 390 to actuate or to move the cam assemblies 298 and 398.

Returning again to FIG. 1, an inomate brace or plate 500 is disposed adjacent to the thoracic leaf 350. The inomate brace or plate includes a cushion 502, which is of a generally rectangular configuration. The operation of the inomate brace 500 is best shown in FIG. 2.

The inomate brace or plate 500 includes a frame 504 to which the cushion 502 is secured. The frame 504 is secured by a pair of hinges 506 and 508 to the cross members 100 and 102, respectively, which, as discussed above, extend transversely between the frame members 92 and 94 of the frame 90. The cross members 100 and 102 extend beyond the frame members 92 and 94, and overlie the outer frame members 42 and 44 of the table frame 40. The inomate brace 500 is secured directly to the rear frame 90 and moves therewith when the rear frame 90 pivots or moves relative to the table frame 40, as discussed above.

The inomate plate 500 moves relative to the rear frame 90 by means of the hinges 506 and 508. This allows the inomate brace 500 to move from its down, or closed, position, as shown in FIG. 1, to its upper or open position, as shown in FIG. 2, in which the brace or plate 500 is disposed substantially perpendicularly to its down, or closed, position.

A plate 510 extends outwardly substantially perpendicularly to the frame 504, to which it is secured. The plate 510 is pinned to a clevis 512, which is in turn secured to a rod 514. The rod 514 pivotally moves relative to a pin 108. The pin 108 comprises a pivot pin, which cooperates with a locking assembly 516 which pivots on and is secured to the pin 108 and which is secured to the rod 514. The rod 514 cooperates with the locking assembly 516 to lock the plate 500 in its upper or open position, as shown in FIG. 2. The pin 108 and the locking assembly 516 are secured to the cross members 104 and 106 of the rear frame 90. The operation of the locking assembly 516 will be discussed, below, in conjunction with the description of the rear frame 90, and its locking assembly, which is substantially identical to the locking assembly 516.

An unlocking bar 518 is used to release the plate 500 from the locking assembly 516 to allow the plate 500 to move from its closed or down position (see FIG. 1) to its open or up position (see FIG. 2), and vice versa. The operation of the locking and unlocking apparatus will be explained in conjunction with FIGS. 9 and 10. A support plate 110 extends between and is secured to the transverse frame members 104 and 106. The unlocking bar 518 is movably disposed on, and is supported by, the plate 110.

Movement of the brace or plate 500 is accomplished by an actuating cylinder 524. The actuating cylinder 524 is secured to the frame 504 through a bracket 520 which is pinned to a rod 522 of the cylinder 524. The actuating cylinder is secured to the frame member 104 through a pin 526. The pin 526 is appropriately secured to the transverse or cross frame member 104.

The operation of the actuating cylinder 524 and its actuating rod 522 is well known and understood in the art. When the inomate brace or plate 500 is in its down or closed position, actuation of the cylinder 524 causes the rod 522 to move outwardly, or away from the cylinder 524. This in turn results in a pivoting movement of the inomate brace 500 from its down position to its full open position. The plate 504 pivots on the hinges 506 and 508 under the urging or bias of the actuating rod 522 which is pinned to the frame 504 of the inomate brace 500 through the bracket 520. When the brace 500 is in its up or open position, the rod 514 is secured by means of the locking assembly 516. The brace 500 is thus usable in its open or up position.

Releasing of the rod 514 by the unlatching of the lock assembly 516 allows the plate 500 to be moved downwardly to its closed or down position. This is accomplished by moving the bar 518, shown in FIGS. 1 and 2, and by the application of manual pressure or force on the plate 500 against its cushion 502. Only a part of the bar 518 is shown in FIG. 2, for purposes of clarity. The bar 518 is bifurcated to allow the rod 514 to move freely. The bar 518 is disposed on and between the frame members 104 and 106, and on a plate 110 which extends between and is secured to the frame members 104 and 106. As the brace 500 pivots downwardly, the actuating rod 522 extends into the actuating cylinder 524 and is thus ready for actuation upon demand. The unlocking bar 518 cooperates with the locking assembly 516 in substantially the same manner as the locking and unlocking system for the rear frame 90, which will be discussed in detail in conjunction with FIGS. 9 and 10.

Returning again to FIG. 1, a base portion 600 is shown disposed about the inomate brace or plate 500 on two sides. The base portion 600 is of a general "L" configuration. It is secured to the rear frame 90 and accordingly pivots therewith.

The base portion 600 includes a cushion 602, shown in FIG. 1, which is of a generally "L" shaped configuration, with an indentation or relieved corner which accommodates the inomate brace or plate 500. The cushion 602 is appropriately secured to the frame 90. The frame 90, as discussed above, and as best shown in FIG. 2, pivots on the pivot pins 70 and 74 in the hinges 72 and 76, respectively, which are secured to the side members 92 and 94, respectively, of the frame 90.

Figure 10:
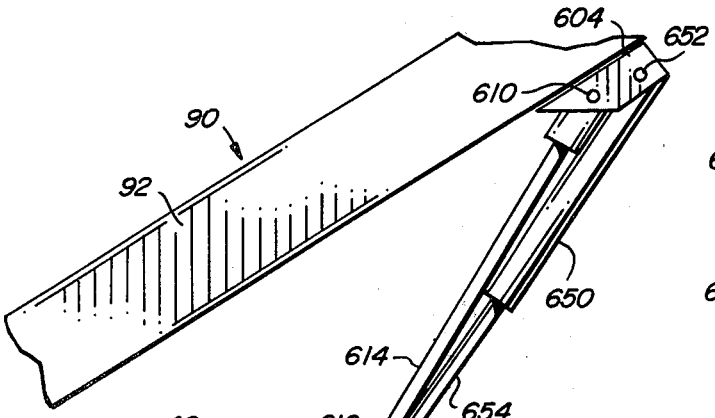
FIG. 10 is an enlarged view in partial section of a portion of the apparatus of FIG. 9.
Figure 10:
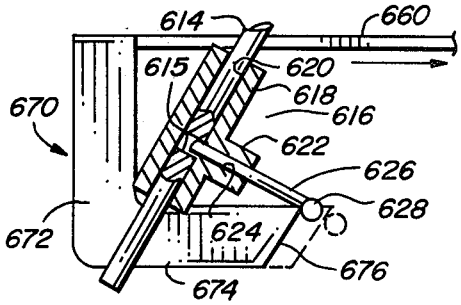
Figure 9:
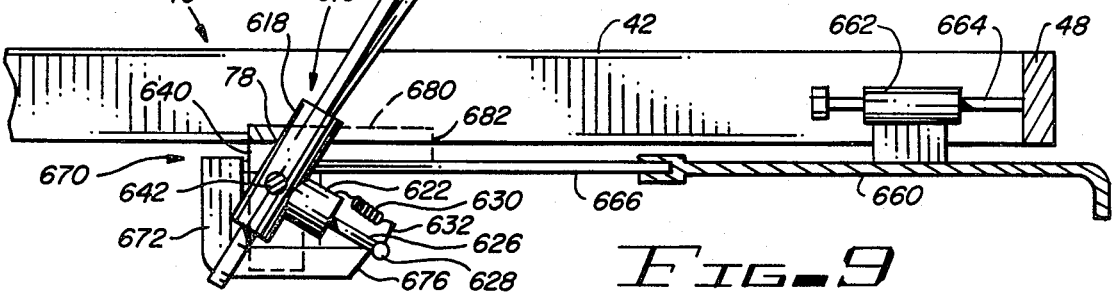
FIG. 9 is a view in partial section of a portion of the apparatus of FIG. 1, taken generally along line 9—9 of FIG. 1.

As best shown in FIGS. 9 and 10, the actuation or pivoting of the frame 90, and its cushion 602, and the brake or plate 502 and its associated elements, is accomplished by a pair of actuating cylinders, of which only an actuating cylinder 650 is shown in FIG. 9. The pair (two) actuating cylinders are not shown in FIG. 2 for purposes of clarity. It will be understood that they are substantially identical to the actuating cylinder 524 in all respects. A single actuating cylinder is sufficient for the plate 500, but the base 600, and the entire rear frame 90, which includes the plate 500, requires two actuating cylinders. The two actuating cylinders are substantially parallel to each other. The actuating cylinder 650 pivots on a bracket 604, which is secured to the frame 90, by means of a pivot pin 652. The bracket 604 also includes a pivot pin 610 which is used to secure one end of a rod 614 to the bracket 604 and accordingly to the frame 90. The rod 614 extends to a lock assembly 616. The lock assembly 616 includes a sleeve 618. A bore 620 extends through the sleeve 618, and the rod 614 is disposed in and extends through the bore 620. The lock assembly 616 is secured to a bracket which comprises a pair of plates 640 and 644, which are in turn secured to the cross member 78 of the table frame 40. A pin or rod 642 is secured to the lock assembly 616 and to the plates 640 and 644. The lock assembly 616 is thus pivotally secured to the table frame 50 through the rod or pin 642 and the bracket 604.

In FIG. 9, the bracket plate 640 is shown extending downwardly from the cross member 78. The bracket plate 640 is shown in phantom in FIG. 2. The actuating cylinder 650 and its associated elements, including the lock assembly 616, are not shown in FIG. 2, for reasons of clarity, as stated above. However, the bracket plate 640 and the pin 642 are outlined in phantom in FIG. 2.

As best shown in FIG. 10, the sleeve 618 includes a boss 622 extending substantially perpendicularly with respect to the sleeve 618 and its bore 620. The boss 622 includes a bore 624 which intersects the bore 620 of the sleeve 618. The rod 614 includes an aperture 615. When the rear frame 90 is oriented in its top or uppermost position with respect to its pivoting relative to the frame 40, the aperture 615 of the rod 614 is disposed in the bore 620 of the sleeve 618 and it is aligned with the bore 624 of the boss 622.

Within the bore 622 is a pin 626. The pin 626 extends outwardly of the bore 622 and terminates outwardly from the bore and from the boss in a tee-handle 628. As shown in FIG. 9, a tension spring 630 extends between the sleeve 618 and a pin 632 which is secured to the handle 628. The spring 630 urges the pin 626 into the bore 624. When the aperture 615 is aligned with the bore 624, the pin 626 extends into the bore 615 under the urging of the spring 630, thus locking the rod 614 relative to the locking assembly 616.

The rod 614 includes a second aperture (not shown), which is aligned within the sleeve 618 with the bore 624 when the frame 90 and the base 600 is in its down or closed position. The pin 626 thus locks the frame 90 and base 600 in both its up and its down positions.

With the base 600 in its down or closed position, the frame 90 is disposed as shown in FIGS. 1 and 2, within the frame 40 and with the cross members 100 and 102 on the top of the side frame members 42 and 44. When the actuating cylinder 650, and its companion cylinder, is activated, the frame 90 and the base portion 600 moves to the position shown in FIG. 9. The actuating cylinder 650 includes a rod 654, the distal end of which, remote from the cylinder 650, is pivotally secured to the pin 642 outboard of the sleeve 618 and the locking assembly 616. The extension of the rod 654 out of the cylinder 650 accordingly allows the frame 90 to pivot relative to the frame 40. In the up or open position, the rod 614 is secured within the lock assembly 616, as shown in FIG. 10, and as discussed above, to secure the frame 90 in its up position.

To release or unlock the rod 614, a handle 660, which includes a pair of bars 666 and 668, is used. The handle 660 comprises a bar which is movably secured to a guide 662. The guide 662 is in turn disposed for axial movement on a rod 664. The rod 664 is secured to the cross frame member 48, which comprises the lower or bottom cross frame member of the frame 40. The handle 660 is of the same general configuration as the handles 290 and 390, discussed above in conjunction with the thoracic leaves 250 and 350, and the handle or bar 82 of the plate 500.

The bar 666 secured by a sleeve to the distal end of the handle 660, remote from the guide 662 and the frame member 48, is secured to a bracket 670. See FIGS. 9 and 10. The bracket 670 is generally "L" shaped, including a vertical arm 672 and a horizontal arm 674. The end of the horizontal arm 674, remote from the vertical arm 672, defines a slanting cam face 676. The cam face 676 is sloping upwardly and outwardly, away from the arm 672. As best shown in FIG. 10, a pull or outward movement of the handle 660 causes the cam face 676 of the bracket 670 to contact the tee-handle 628, which is secured to the pin 626. Movement of the handle 660 and the bracket 670 causes a downward and outward movement of the pin 626 with respect to the bore 624 and with respect to the aperture 615 of the rod 614 in the bore 620 of the sleeve 618. Sequential movement of the handle 660 results in the sequential movement of the bracket 670 to cause the cam face 676 to move to the position shown in phantom in FIG. 10. This causes a resulting or corresponding movement of the handle 628, as is shown in phantom in FIG. 10, to withdraw the lock pin 626 out of the aperture 615 of the rod 614. With the lock pin 626 withdrawn from the rod 614, the rod 614 may then move relative to the sleeve 618 in response to movement of the frame 90. The frame 90 may thus be moved downwardly, from the position shown in FIG. 9, to its full down or rest position. The full down or rest position is shown in FIG. 10, and the up position is shown in phantom in FIG. 1.

A bracket substantially identical to the bracket 670 is also secured to the rod 668. The two brackets, of course, move in unison against the handle 628.

The functioning of the locking assembly 516, and the rod 514, is substantially identical to that described above and shown in FIGS. 9 and 10. Similarly, the handle or bar 82 is bifurcated and it includes two L-shaped brackets which bear against a handle to withdraw a pin out of apertures in the rod 514 to unlock the rod for movement upwardly and downwardly.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Table apparatus for supporting a body, comprising, in combination:

frame means, including a central rod;

support means for supporting the frame means;

head supporting means adjustably secured to the frame means for supporting the head portion of the body;

thoracic leaf means, including a first leaf and a second leaf pivotally secured to the central rod and independently movable on the rod to a plurality of positions;

first lock means for locking the first thoracic leaf in any of the plurality of positions and for releasing the first thoracic leaf from a locked position;

second lock means for locking the second thoracic leaf in any of the plurality of positions and for releasing the second thoracic leaf from a locked position;

first release means connected to the first and second lock means for substantially simultaneously releasing the first and second thoracic leaves from their locked positions;

rear frame means secured to and movable on the frame means between an up position and a down position;

third lock means for locking the rear frame means in its up and its down positions;

second release means for releasing the rear frame means from its locked positions;

inomate plate means secured to and movable with the rear frame means and pivotable thereon between a closed position and an open position;

fourth lock means for locking the inomate plate means in the open and in the closed positions; and third release means for releasing the inomate plate means from its locked positions.

2. The apparatus of claim 1 in which the frame means includes means for pivoting the frame means relative to the support means.

3. The apparatus of claim 1 in which the rear frame means includes a rear frame pivotally secured to the frame means.

4. The apparatus of claim 1 in which the frame means includes a first side member;

a second side member;

a first end member secured to the first and second side members; and a second end member secured to the first and second side members remote from the first end member.

5. The apparatus of claim 4 in which the head supporting means is secured to the first end member of the frame means.

6. The apparatus of claim 4 in which the support means includes a plate secured to the first and second side members of the frame means between the first and second end members.

7. The apparatus of claim 6 in which the frame means is movably secured to the plate of the support means.

8. The apparatus of claim 7 in which the frame means further includes lock means for locking the frame means in one of a plurality of positions relative to the support means.

9. The apparatus of claim 4 in which the central rod of the frame means is secured to the first end member between the first and second side members.

10. The apparatus of claim 9 in which the first lock means includes a first pin secured to the frame means, a first bar secured to the first thoracic leaf and having a plurality of notches for receiving the first pin for locking the first thoracic leaf in any position of the plurality of positions, and the second lock means includes a second pin secured to the frame means and a second bar secured to the second thoracic leaf and having a plurality of notches for receiving the second pin for locking the second thoracic leaf in any position of the plurality of positions.

11. The apparatus of claim 10 in which the first release means includes a first lever secured to the first bar for moving the first bar away from the first pin, and a second lever secured to the second bar for moving the second bar away from the second pin.

12. The apparatus of claim 10 in which the frame means further includes cross member means secured to the first and second side members, and the first and second pins are secured to the cross member means.

13. The apparatus of claim 12 in which the first release means includes means movably secured to the cross member means for moving the first bar away from the first pin and for moving the second bar away from the second pin.

14. The apparatus of claim 13 in which the means movably secured to the cross members includes first cam means secured to the cross members for moving the first bar away from the first pin, first cable means secured to the first end member and to the first cam means for moving the first cam means, second cam means secured to the cross members for moving the second bar away from the second pin, and second cable means secured to the first end member and to the second cam means for moving the second cam means.

15. The apparatus of claim 13 in which the first release means further includes a first lever secured to the first thoracic leaf and to the first bar for moving the first bar away from the first pin, and a second lever secured to the second thoracic leaf and to the second bar for moving the second bar away from the second pin.

* * * * *